US009165706B2

(12) United States Patent
Ishida et al.

(10) Patent No.: US 9,165,706 B2
(45) Date of Patent: Oct. 20, 2015

(54) COIL COMPONENT

(71) Applicant: MURATA MANUFACTURING CO., LTD., Kyoto (JP)

(72) Inventors: Kosuke Ishida, Kyoto-fu (JP); Kiyotaka Nishi, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/296,748

(22) Filed: Jun. 5, 2014

(65) Prior Publication Data

US 2014/0285307 A1 Sep. 25, 2014

Related U.S. Application Data

(63) Continuation of application No. PCT/JP2013/050885, filed on Jan. 18, 2013.

(30) Foreign Application Priority Data

Jan. 20, 2012 (JP) ..... 2012-010205

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 17/00*** | (2006.01) |
| ***H01F 17/04*** | (2006.01) |

(52) U.S. Cl.

CPC ..... *H01F 27/2804* (2013.01); *H01F 17/0013* (2013.01); *H01F 17/04* (2013.01); *H01F 2017/002* (2013.01); *H01F 2027/2809* (2013.01)

(58) Field of Classification Search

CPC . H01F 5/003; H01F 17/0006; H01F 17/0013; H01F 27/2804; H01F 27/2828; H01F 27/2852; H01F 17/04; H01F 2017/002; H01F 2027/2809

USPC ..... 336/200, 223, 234, 147

See application file for complete search history.

(56) References Cited

U.S. PATENT DOCUMENTS

| | | | | |
|---|---|---|---|---|
| 4,313,152 | A * | 1/1982 | Vranken | 361/765 |
| 2003/0076211 | A1 * | 4/2003 | Matsuta et al. | 336/200 |
| 2007/0205856 | A1 * | 9/2007 | Matsunaga et al. | 336/200 |

FOREIGN PATENT DOCUMENTS

| | | | |
|---|---|---|---|
| JP | H05-291044 | A | 11/1993 |
| JP | H08-203737 | A | 8/1996 |
| JP | 4381417 | B2 | 12/2009 |

OTHER PUBLICATIONS

International Search Report; PCT/JP2013/050885; Apr. 23, 2013.
Written Opinion of the International Searching Authority; PCT/JP2013/050885; Apr. 23, 2013.

* cited by examiner

*Primary Examiner* — Mangtin Lian
(74) *Attorney, Agent, or Firm* — Studebaker & Brackett PC

(57) ABSTRACT

A coil component is provided with a first magnetic substrate, a laminate body, and a second magnetic substrate. A coil is formed inside the laminate body. In the coil, a plurality of coil patterns provided on one surface of an insulation layer and a plurality of coil patterns provided on the other surface of the insulation layer are connected at multiple locations through vias. The coil patterns are configured in such a manner that a portion which is in contact with each via has a wider width widened with equal size from the center of a coil pattern to both sides thereof in the width direction, and a portion which is adjacent to the portion having the wider width across a gap has a narrower width(s) narrowed with equal size from the center of the coil pattern to both sides thereof in the width direction.

6 Claims, 11 Drawing Sheets

COIL COMPONENT

CROSS REFERENCE TO RELATED APPLICATIONS

This application claims benefit of priority to Japanese Patent Application No. 2012-010205 filed Jan. 20, 2012, and to International Patent Application No. PCT/JP2013/050885 filed on Jan. 18, 2013, the entire content of each of which is incorporated herein by reference.

TECHNICAL FIELD

The present technical field relates to a coil component capable of achieving a high inductance value and improving connection reliability of coil patterns, and relates to a coil component capable of ensuring a high common-mode attenuation when being configured as a common-mode choke coil.

BACKGROUND

Conventionally, a wire-wound coil having a wire wound around a core made of ferrite or the like is generally used as a coil component such as a common-mode choke coil. However, since downsizing has become an important issue in the coil component, in recent years, a common-mode choke coil of a chip type, which is manufactured by using a thin-film formation technique or a ceramic multilayer technique, has been widely used.

For example, Japanese Patent Laying-Open No. 8-203737 discloses a common-mode choke coil of the chip type. FIG. 14 of Japanese Patent Laying-Open No. 8-203737 illustrates a common-mode choke coil of the chip type in which a laminate body is formed on a first magnetic substrate by stacking an insulation layer (insulator layer) and coil patterns according to the thin-film formation technique, and thereafter, a second magnetic substrate is provided on the laminate body, and a first coil and a second coil each composed of spiral coil patterns are formed inside the laminate body.

If the common-mode choke coil is further downsized, the space for forming the coil becomes insufficient, and thus the coil has to be shortened in length, which reduces the inductance value thereof, making it difficult to ensure a high common-mode attenuation.

As a solution to the above problem, for example, as illustrated in FIG. 6 of Japanese Patent Laying-Open No. 5-291044, an approach has been considered to increase the coil length by adopting such a coil that includes a first coil pattern layer composed of a plurality of conductors, an insulator layer and a second coil pattern layer composed of a plurality of conductors. The conductors of the first coil pattern layer and the conductors of the second coil pattern layer are electrically connected alternately through the intermediary of connection members provided in the insulator layer.

According to the above approach, in order to secure the connection between each conductor of the first coil pattern layer and each conductor of the second coil pattern layer, the cross-sectional area of a connecting portion for connecting the two is needed to be increased to some extent. However, since the line width of each conductor in the coil pattern layer will increase as long as the cross-sectional area of the connecting portion is increased, which decreases the inner diameter of the coil, and thereby the inductance value cannot be ensured, which makes the common-mode attenuation become smaller.

In addition, since all of the connecting portions for connecting the plurality of conductors respectively have the same area, the connecting portions located on the outer periphery of the coil are more susceptible to stress than the connecting portions located on the inner periphery of the coil. Thus, when the common-mode choke coil is subjected to an external thermal shock repeatedly, the connecting portions located on the outer periphery of the coil may disconnect away from each other, making it difficult to ensure the connection reliability.

SUMMARY

Technical Problem

Therefore, an object of the present disclosure to provide a coil component capable of achieving a high inductance value and improving connection reliability of coil patterns, and a common-mode choke coil capable of ensuring a high common-mode attenuation when the coil component is employed to form such a common-mode choke coil.

Solution to Problem

A coil component according to the present disclosure includes a laminate body which is formed by stacking an insulation layer and coil patterns in the thickness direction, and a plurality of coil patterns provided on one surface of the insulation layer and a plurality of coil patterns provided on the other surface of the insulation layer are connected at multiple locations through a plurality of vias being formed to penetrate the insulation layer and pass through one surface and the other surface of the insulation alternately so as to form a coil. At least the plurality of coil patterns provided on one surface of the insulation layer or the plurality of coil patterns provided on the other surface of the insulation layer are configured in such a manner that a portion which is in contact with the via has a wider width widened with equal size from the center of a coil pattern to both sides thereof in the width direction in comparison to another portion which is not in contact with the via joining the portion, a portion which is adjacent to the portion having the wider width across a gap extending along the coil pattern in a direction parallel to the coil pattern has a narrower width narrowed with equal size from the center of the coil pattern to both sides thereof in the width direction in comparison to another portion joining the portion, the size widened for the portion having the wider width (the size difference between the width of the widened portion and the width of the adjoining portion) and the size narrowed for the portion having the narrower width (the size difference between the width of the narrowed portion and the width of the adjoining portion) are equal to each other, and the plurality of vias being formed to penetrate the insulation layer are configured to have a longer length in the longitudinal direction of the coil pattern as the plurality of vias move closer to the outer periphery of the insulation layer from the center of the insulation layer.

Thereby, the coil can be obtained at a longer length, and the inner diameter of the coil pattern can be enlarged. As a result, a high inductance value can be achieved. Further, when, for example, the coil component of the present disclosure is employed to form a common-mode choke coil, it is possible to ensure a high common-mode attenuation.

In the case where the insulation layer is made of resin, since the thermal expansion of the insulation layer becomes larger as it approaches closer to the outer periphery thereof, the disconnection is likely to occur at the via. However, as described above, since the via is formed to have a longer length as it moves closer to the outer periphery of the insulation layer, the disconnection at the via is reduced.

Moreover, the plurality of vias being formed to penetrate through the insulation layer may be arranged in a zigzag manner from the center of the insulation layer toward any side of the insulation layer. Thereby, one main surface and the other main surface of the insulation layer can be efficiently utilized, which makes it possible to increase the length of the coil patterns to be formed on the main surfaces, and as a result, the length of the coil to be formed from the coil patterns can be made longer.

Advantageous Effects of Disclosure

According to the coil component of the present disclosure, it is possible to achieve a high inductance value and improve connection reliability of coil patterns. If the coil component is employed to form a common-mode choke coil, it is possible to ensure a high common-mode attenuation.

Moreover, according to the coil component of the present disclosure, it is possible to increase the cross-sectional area of the via and thus the disconnection will not occur at the via, ensuring a high connection reliability.

DETAILED DESCRIPTION

Hereinafter, an embodiment of the present disclosure will be described with reference to the drawings.

A common-mode choke coil 100 according to an embodiment of a coil component of the present disclosure is illustrated in FIGS. 1 to 11.

Figure 1:
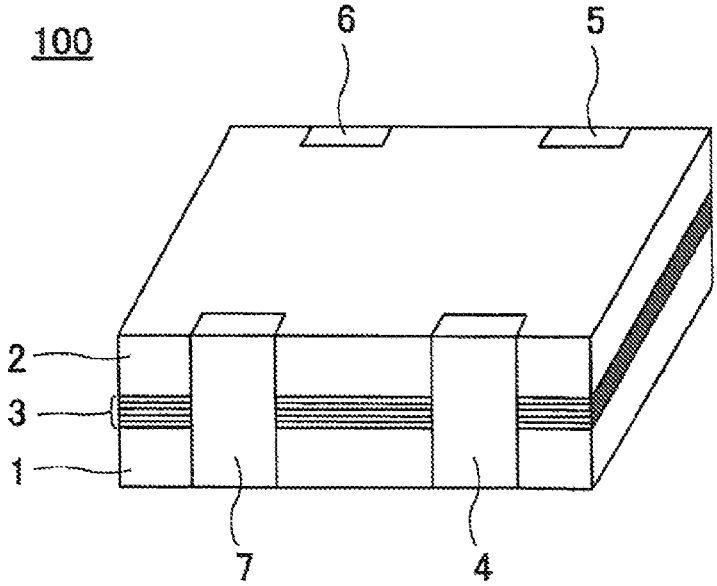
FIG. 1 is a perspective view illustrating a common-mode choke coil 100 according to an embodiment of the present disclosure.
Figure 3A:
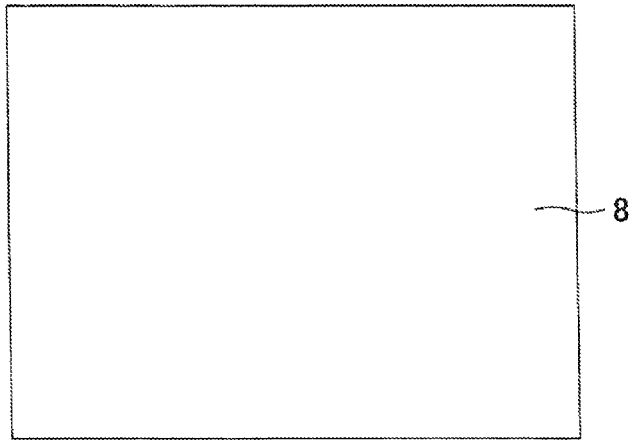
FIGS. 3(A) and 3(B) are plan views illustrating steps subsequent to FIG. 2(B).
Figure 3B:
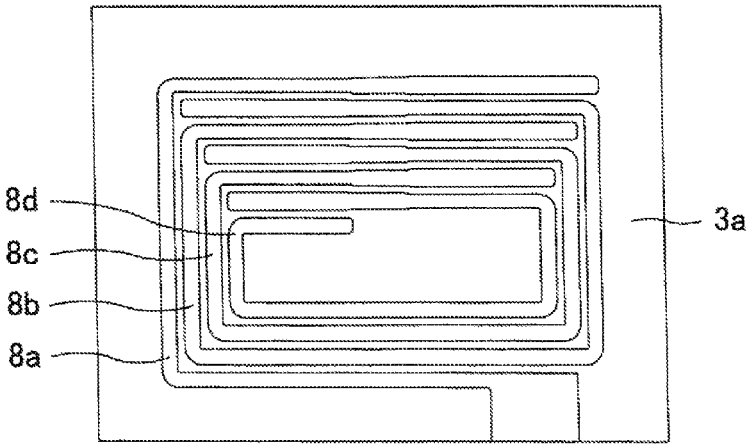
Figure 4A:
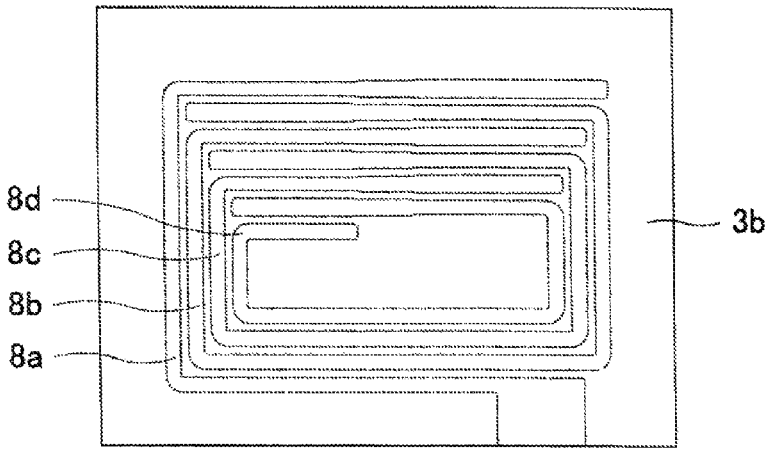
FIGS. 4(A) and 4(B) are plan views illustrating steps subsequent to FIG. 3(B).
Figure 4B:
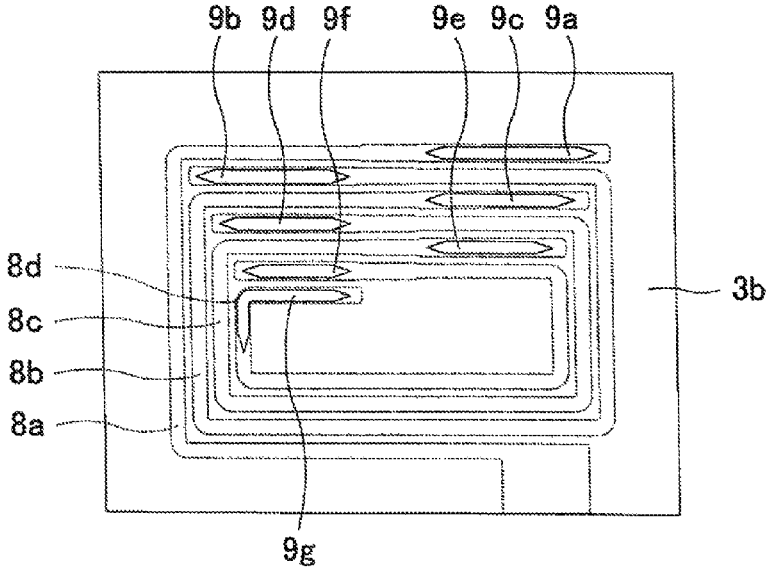
Figure 9A:
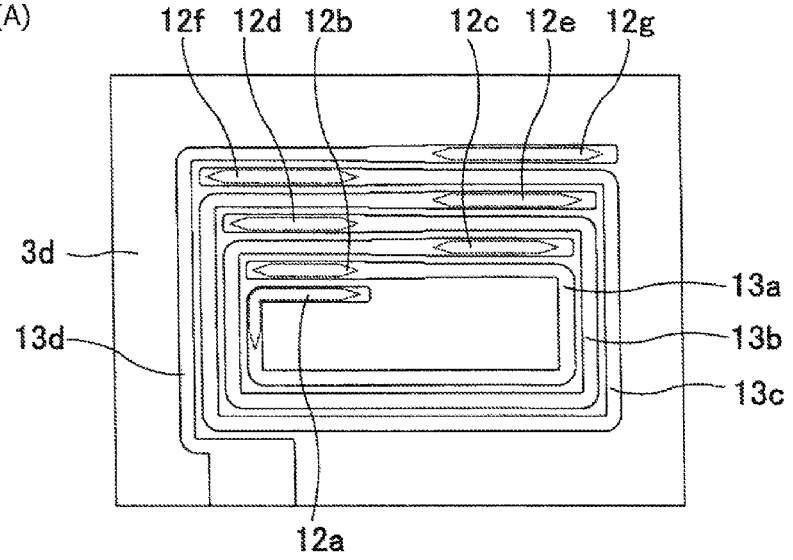
FIGS. 9(A) and 9(B) are plan views illustrating steps subsequent to FIG. 8(B).
Figure 9B:
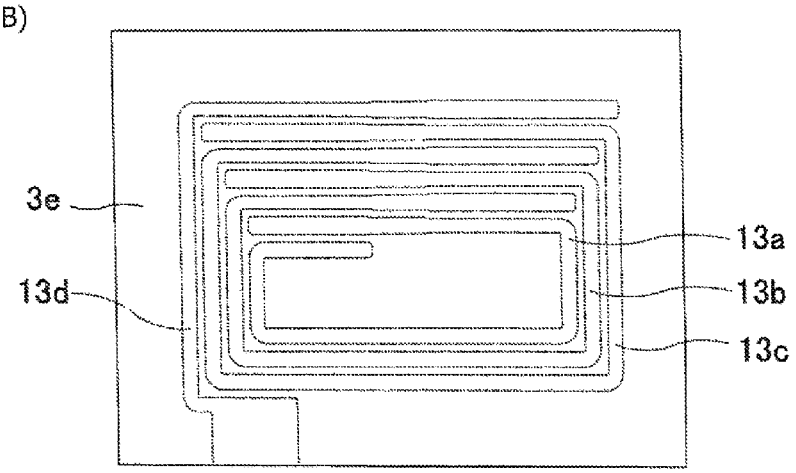
Figure 10:
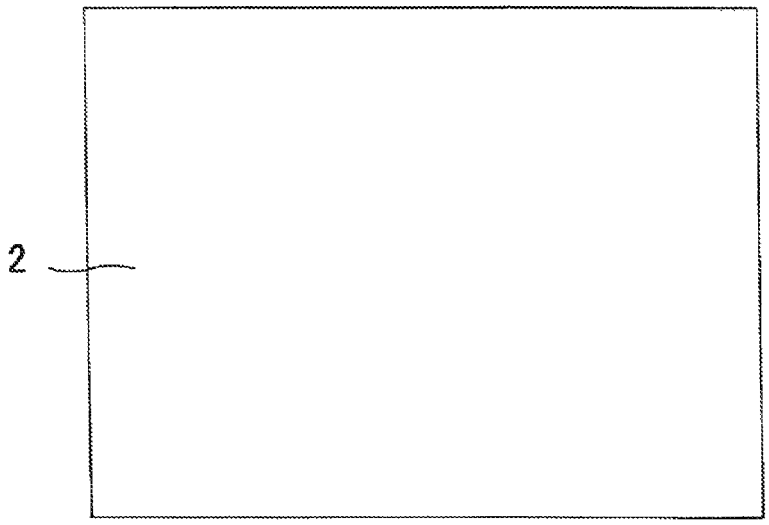
FIG. 10 is a plan view illustrating a step subsequent to FIG. 9(B).
Figure 11:
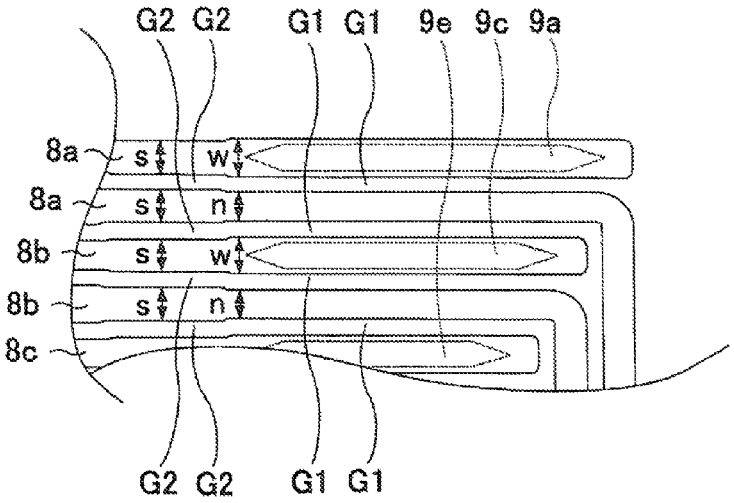
FIG. 11 is a plan view illustrating a main part of FIG. 3(B).

Specifically, FIG. 1 is a perspective view of common-mode choke coil 100, FIG. 2(A) to FIG. 10 are plan views illustrating respective steps for producing a laminate body 3 of a common-mode choke coil 100 through photolithography, and FIG. 11 is a plan view illustrating a main part of FIG. 4(B).

As illustrated in FIG. 1, a common-mode choke coil 100 includes a first magnetic substrate 1 and a second magnetic substrate 2 sandwiching therebetween a laminate body 3 formed through photolithography. Moreover, terminal electrodes 4, 5, 6, and 7 are provided on surfaces of the common-mode choke coil 100.

First magnetic substrate 1 and second magnetic substrate 2 are made of ferrite, for example.

Laminate body 3 is formed through photolithography by stacking coil patterns and an insulation layer in the thickness direction. In the present embodiment, two coils are formed inside laminate body 3, and the two coils are electromagnetically coupled to form the common-mode choke coil.

Terminal electrodes 4, 5, 6 and 7 are provided for leading the ends of the coils formed inside laminate body 3 to the outside, and are made by baking, for example, a conductive paste whose main component is Ag, Pd, Cu or Al, or any alloy containing at least one of these metals.

Hereinafter, with reference to FIG. 2 (A) to FIG. 10, an example of a production method of a common-mode choke coil 100 will be described. In the actual producing process, it is very common that a large number of common-mode choke coils are produced in a batch on a mother substrate and then the mother substrate is divided into individual common-mode choke coils. However, for the sake of convenience, in the following the description will be carried out on the case where only a single common-mode choke coil is produced.

Firstly, as illustrated in FIG. 2 (A), first magnetic substrate 1 is prepared.

Subsequently, laminate body 3 is formed on first magnetic substrate 1 through photolithography.

Figure 2A:
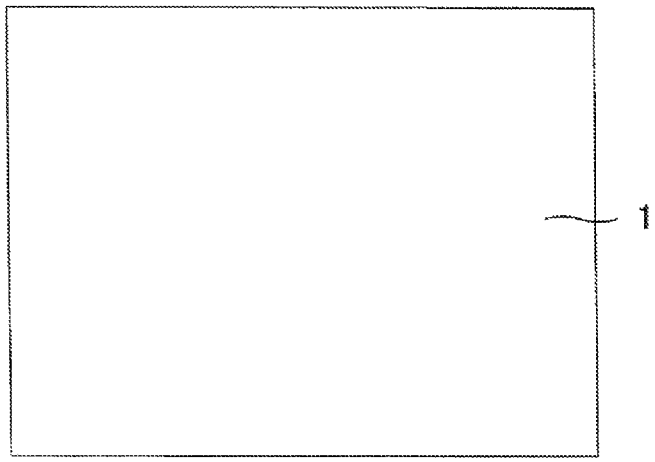
FIGS. 2(A) and 2(B) are plan views illustrating steps to be performed in an example of a production method of common-mode choke coil 100, respectively.
Figure 2B:
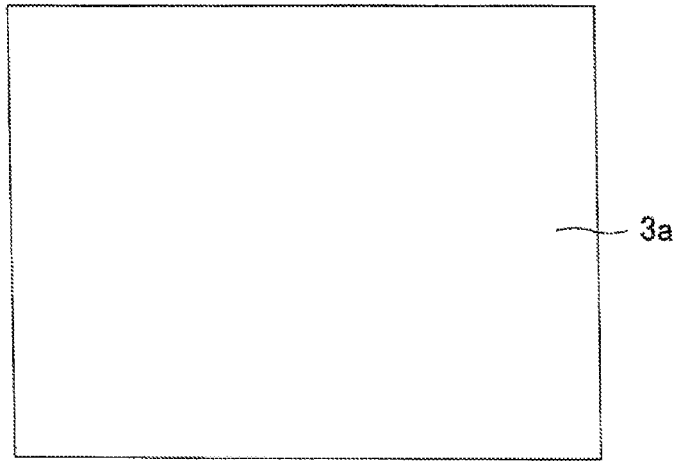

Specifically, first, as illustrated in FIG. 2(B), an insulation layer 3*a* is formed on first magnetic substrate 1 through photolithography. Insulation layer 3*a* may be formed from various kinds of materials such as polyimide resin, epoxy resin and benzocyclobutene resin.

Next, as illustrated in FIG. 3(A), a conductive film 8 is formed on insulation layer 3*a* through sputtering, evaporation or the like. Conductive film 8 may be formed from, for example, Ag, Pd, Cu or Al, or any alloy containing at least one of these metals.

Then, as illustrated in FIG. 3(B), conductive film 8 is processed through photolithographic etching to form annular coil patterns 8*a*, 8*b*, 8*c* and 8*d* each having a predetermined length. Specifically, coil patterns 8*a*, 8*b*, 8*c* and 8*d* are formed through a series of steps such as resist coating, exposing, developing and etching.

One end of coil pattern 8*a* is led out to the outer edge of insulation layer 3*a* to form a lead-out section of a rectangular shape in the vicinity of the outer edge for connecting with terminal electrode 4. In order to improve the connection reliability to vias which will be described later, the other end of coil pattern 8*a*, both ends of coil pattern 8*b*, both ends of coil pattern 8*c* and one end of coil pattern 8*d* are formed into a portion having a wider width widened with equal size from the center of the coil pattern to both sides thereof in the width direction in comparison to another portion adjoining to each end. Meanwhile, a portion of the coil pattern which is adjacent to the portion having the wider width across a gap extending along the coil pattern in a direction parallel to the coil pattern is formed to have a narrower width narrowed with equal size from the center of the coil pattern to both sides thereof in the width direction in comparison to another portion joining the portion. The size widened for the portion having the wider width (the size difference between the width of the widened portion and the width of the adjoining portion) and the size narrowed for the portion having the narrower width (the size difference between the width of the narrowed portion and the width of the adjoining portion) are equal to each other. As a result, the width of the gap formed between the portion having the wider width and the portion having the narrower width is equal to the width of the gap formed between the portions without being formed into the portion having the wider width or the portion having the narrower width.

The details will be described later with reference to FIG. 11.

Next, as illustrated in FIG. 4(A), an insulation layer 3*b* is formed on insulation layer 3*a* provided with coil patterns 8*a*, 8*b*, 8*c* and 8*d*. Insulation layer 3*b* is formed from the same material and in the same manner as insulation layer 3*a*. In FIG. 4(A), coil patterns 8*a* 8*b*, 8*c* and 8*d* underlying insulation layer 3*b* are represented by dashed lines (hereinafter, when a via or a coil pattern is underlying a layer, it may be represented by dashed lines).

Next, as illustrated in FIG. 4(B), insulation layer 3*b* is processed through photolithography to form through holes, and thereby vias 9*a*, 9*b*, 9*c*, 9*d*, 9*e*, 9*f* and 9*g* are formed. Specifically, vias 9*a*, 9*b*, 9*c*, 9*d*, 9*e*, 9*f* and 9*g* are formed through a series of steps such as resist coating, exposing, developing and etching.

As a result, the other end of coil pattern 8*a* is exposed from via 9*a*. One end of coil pattern 8*b* is exposed from via 9*b*, and the other end of coil pattern 8*b* is exposed from via 9*c*. One end of coil pattern 8*c* is exposed from via 9*d*, and the other end of coil pattern 8*c* is exposed from via 9*e*. One end of coil pattern 8*d* is exposed from via 9*f*, and the other end of coil pattern 8*d* is exposed from via 9*g*.

Each of vias 9*a*, 9*b*, 9*c*, 9*d*, 9*e*, 9*f* and 9*g* is formed into an elongated shape which has a longer length in the longitudinal direction of each of coil patterns 8*a* to 8*d* and has both ends thereof sharply formed. It should be noted that via 9*g* is curved at a middle location so as to match the shape of coil pattern 8*d*.

Via 9*g*, vias 9*a*, 9*b*, 9*c*, 9*d*, 9*e* and 9*f* are formed to have a longer length in the longitudinal direction of each of coil patterns 8*a* to 8*d* as each via moves closer to the outer periphery of insulation layer 3*b* from the center of insulation layer 3*b*. In the case where insulation layer 3*b* is made of resin, since the thermal expansion becomes larger as approaching closer to the outer periphery thereof, insulation layer 3*b* is likely to have the disconnection occurring at each of vias 9*a* to 9*f*. However, as described above, since each of vias 9*a* to 9*f* is formed to have a longer length as it moves closer to the outer periphery of insulation layer 3*b*, the disconnection at each of vias 9*a* to 9*f* is reduced.

Via 9*g*, vias 9*a*, 9*b*, 9*c*, 9*d*, 9*e* and 9*f* are arranged in a zigzag manner from the center of insulation layer 3*b* toward any side (the upper side in FIG. 4(B)) of insulation layer 3*b*. According to such arrangement, it is possible to efficiently utilize the lower surface of insulation layer 3*b*, and thereby, the length of each coil pattern 8*a* to 8*d* to be formed thereon can be made longer.

Figure 5A:
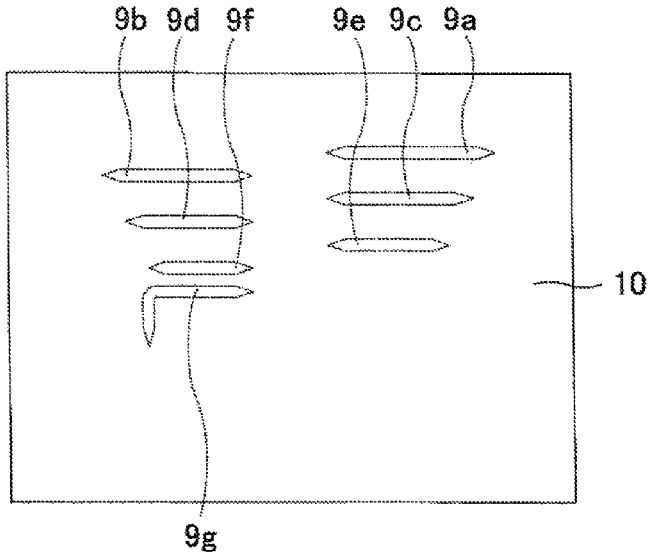
FIGS. 5(A) and 5(B) are plan views illustrating steps subsequent to FIG. 4(B).

Next, as illustrated in FIG. 5(A), a conductive film 10 is formed on insulation layer 3*b* provided with vias 9*a*, 9*b*, 9*c*, 9*d*, 9*e*, 9*f* and 9*g*.

Figure 5B:
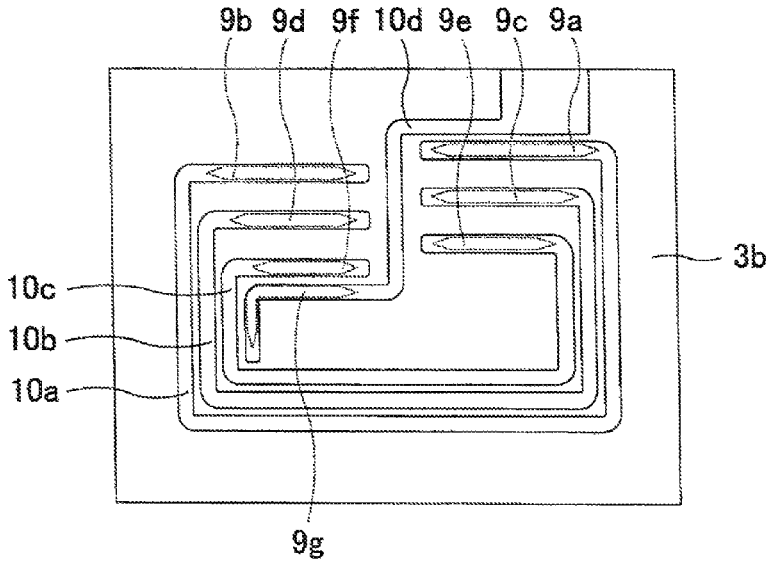

Then, as illustrated in FIG. 5(B), conductive film 10 is processed through photolithographic etching to form coil patterns 10*a*, 10*b* and 10*c*, and a lead-out electrode 10*d*.

As a result, one end of coil pattern 10*a* is connected through via 9*a* to the other end of coil pattern 8*a*, and the other end of coil pattern 10*a* is connected through via 9*b* to one end of coil pattern 8*b*. One end of coil pattern 10*b* is connected through via 9*c* to the other end of coil pattern 8*b*, and the other end of coil pattern 10*b* is connected through via 9*d* to one end of coil pattern 8*c*. One end of coil pattern 10*c* is connected through via 9*e* to the other end of coil pattern 8*c*, and the other end of coil pattern 10*c* is connected through via 9*f* to one end of coil pattern 8*d*. One end of lead-out electrode 10*d* is connected through via 9*g* to the other end of coil pattern 8*d*. The other end of lead-out electrode 10*d* is led out to the outer edge of insulation layer 3*b* to form a lead-out section of a rectangular shape in the vicinity of the outer edge for connecting with terminal electrode 5.

Thereby, a first coil is formed. The first coil has a coil path including sequentially terminal electrode 4, coil pattern 8*a*, via 9*a*, coil pattern 10*a*, via 9*b*, coil pattern 8*b*, via 9*c*, coil pattern 10*b*, via 9*d*, coil pattern 8*c*, via 9*e*, coil pattern 10*c*, via 9*f*, coil pattern 8*d*, via 9*g*, lead-out electrode 10*d*, and terminal electrode 5. The first coil is configured to have the coil patterns passing through one surface and the other surface of insulation layer 3*b* alternately for multiple times and have a long coil length.

With reference to FIG. 3(B) and FIG. 11 which illustrates an enlarged view of a main part of FIG. 3(B), the description will be carried out on the line width of each coil pattern 8*a* to 8*d*, which is the characteristic configuration in the present disclosure. In FIG. 11, the portions of coil patterns 8*a*, 8*b* and 8*c* in respective contact with vias 9*a*, 9*c* and 9*e* are indicated by dashed lines.

As can be seen from FIG. 11, a portion of coil pattern 8*a* in contact with via 9*a* has a wider line width (w) widened with equal size from the center of coil pattern 8*a* to both sides thereof in the width direction of coil pattern 8*a* in comparison to another portion which adjoins the portion and has a standard line width (s). A portion of coil pattern 8*a* which is adjacent to (i.e., the same coil pattern 8*a* folds back and becomes adjacent to) the portion having the wider line width (w) of coil pattern 8*a* across a gap has a narrower line width (n) narrowed with equal size from the center of coil pattern 8*a* to both sides thereof in the width direction of coil pattern 8*a* in comparison to another portion which adjoins the portion and has the standard line width (s). Coil pattern 8*b* in contact with via 9*c* and coil pattern 8*c* in contact with via 9*e* are formed in a similar manner.

The size difference between the line width (w) of the widened portion and the standard line width (s) of the adjoining portion and the size difference between the line width (n) of the narrowed portion and the standard line width (s) of the adjoining portion are equal to each other, and as a result, the width of a gap G1 defined between the widened portion and the narrowed portion is identical to the width of a gap G2 defined between the portions without being formed into the widened portion or the narrowed portion.

Since the coil component of the present disclosure has the coil pattern as described above, it is possible to utilize efficiently the surfaces of the insulation layer so as to form more coil patterns, and since the coil patterns can be made to pass through one surface and the other surface of the insulation layer alternately for multiple times, the coil can be formed with a longer coil length. Further, since the line width of the coil pattern is not made wider over the entire length of the coil pattern, the inner diameter of the coil pattern is not reduced. Therefore, the coil can be made with a high inductance value. Furthermore, when the coil component of the present disclosure is configured as the common-mode choke coil in the present embodiment, it is possible to ensure a high common-mode attenuation.

Figure 12:
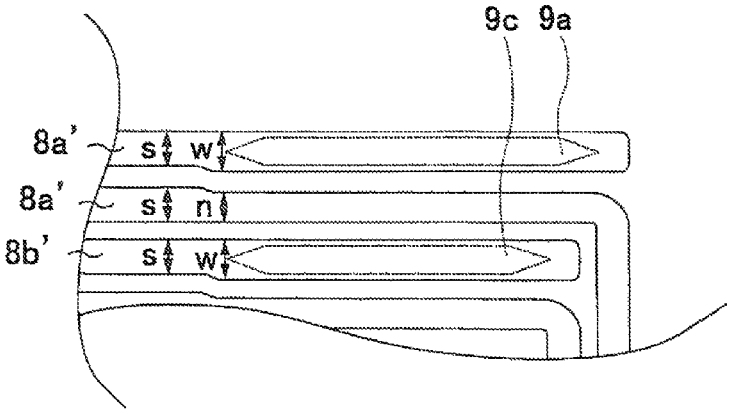
FIG. 12 is a plan view illustrating coil patterns of a common-mode choke coil in a comparative example.

Since the distal end of each coil pattern is formed in line symmetry with respect to the center line of the coil pattern, the formation of the coil pattern through photolithography (photolithographic etching) is stable without disconnection or short-circuits to adjacent coil patterns, and thereby the coil component of the present disclosure is high in connection reliability. In contrast, for example, in coil patterns 8*a*' and 8*b*' illustrated in FIG. 12 as a comparative example, since the distal end of each coil pattern is not formed in line symmetry with respect to the center line of the coil pattern but formed biasing to either side, the formation of the coil pattern through photolithography is unstable, and thus, the coil pattern may encounter problems such as disconnections or short-circuits to adjacent coil patterns.

Figure 6A:
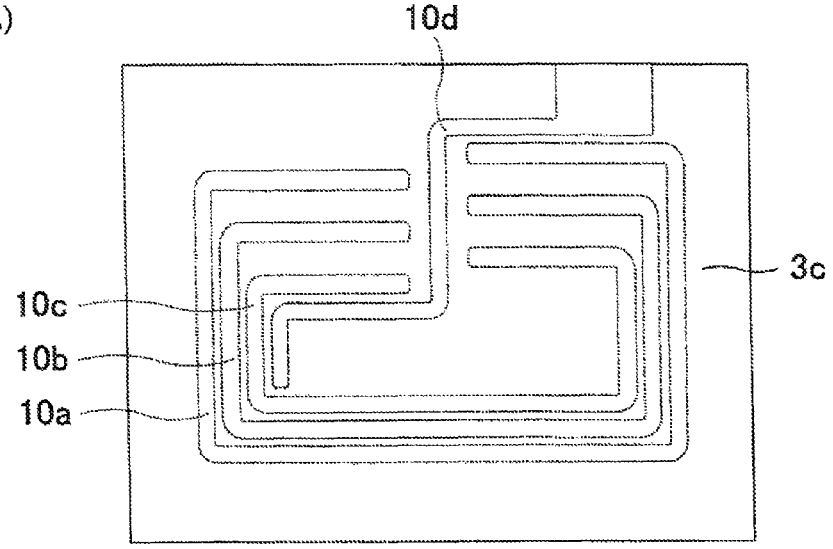
FIGS. 6(A) and 6(B) are plan views illustrating steps subsequent to FIG. 5(B).

Returning back to the description of the production method of common-mode choke coil 100, subsequent to the first coil as described above, a second coil is formed in a similar manner. Specifically, as illustrated in FIG. 6(A), an insulation layer 3*c* is formed on insulation layer 3*b* provided with coil patterns 10*a*, 10*b* and 10*c*, and lead-out electrode 10*d*.

Figure 6B:
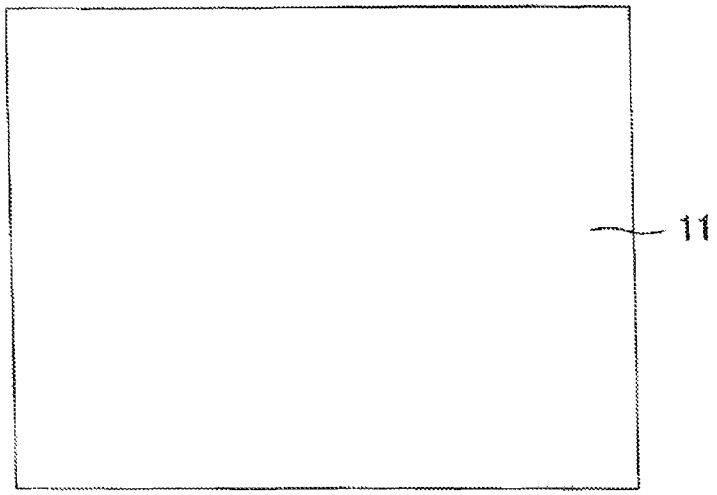

Next, as illustrated in FIG. 6(B), a conductive film 11 is formed on insulation layer 3*c*.

Figure 7A:
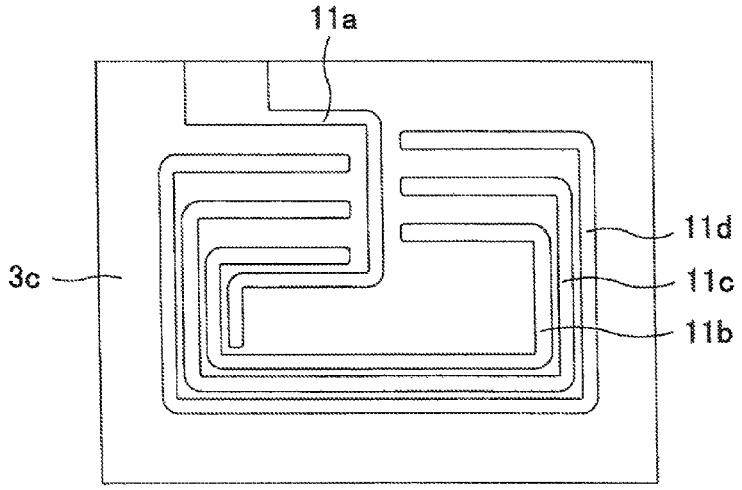
FIGS. 7(A) and 7(B) are plan views illustrating steps subsequent to FIG. 6(B).

Then, as illustrated in FIG. 7(A), conductive film 11 is processed through photolithographic etching to form a lead-out electrode 11*a* and coil patterns 11*b*, 11*c* and 11*d*. One end of lead-out electrode 11*a* is led out to the outer edge of insulation layer 3*c* to form a lead-out section of a rectangular shape in the vicinity of the outer edge for connecting with terminal electrode 6.

Figure 7B:
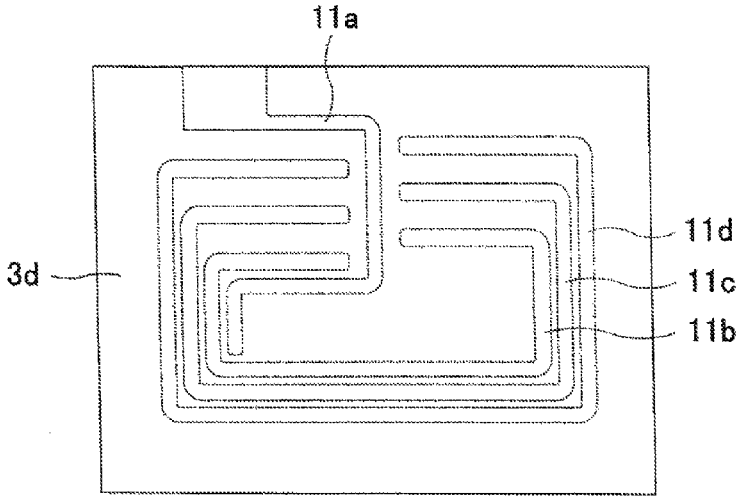

Next, as illustrated in FIG. 7(B), an insulation layer 3*d* is formed on insulation layer 3*c* provided with lead-out electrode 11*a* and coil patterns 11*b*, 11*c* and 11*d*.

Figure 8A:
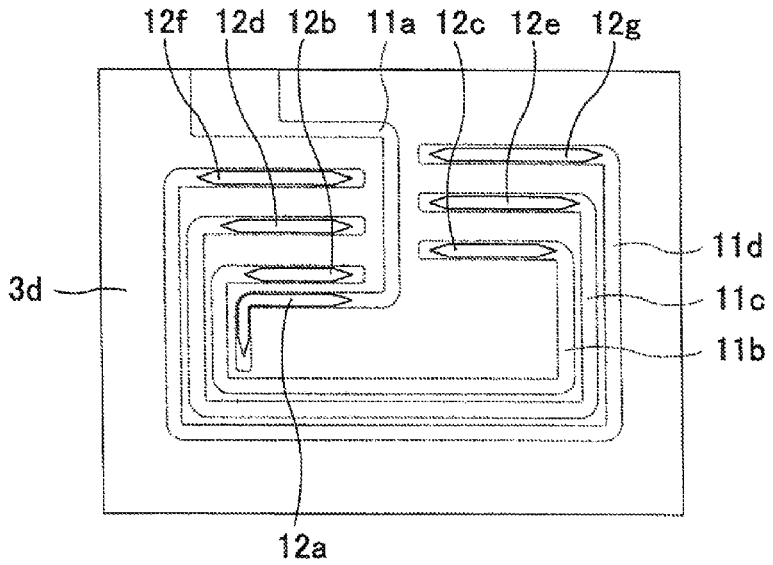
FIGS. 8(A) and 8(B) are plan views illustrating steps subsequent to FIG. 7(B).

Then, as illustrated in FIG. 8(A), insulation layer 3*d* is processed through photolithography to form through holes, and thereby vias 12*a*, 12*b*, 12*c*, 12*d*, 12*e*, 12*f* and 12*g* are formed.

As a result, the other end of lead-out electrode 11*a* is exposed from via 12*a*. One end of coil pattern 11*b* is exposed from via 12*b*, and the other end of coil pattern 11*b* is exposed from via 12*c*. One end of coil pattern 11*c* is exposed from via 12*d*, and the other end of coil pattern 11*c* is exposed from via 12*e*. One end of coil pattern 11*d* is exposed from via 12*f*, and the other end of coil pattern 11*d* is exposed from via 12*g*.

Figure 8B:
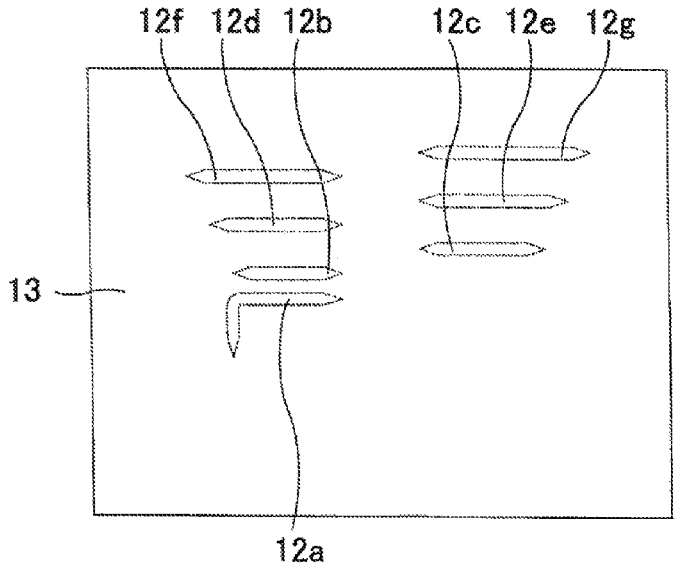

Next, as illustrated in FIG. 8(B), a conductive film 13 is formed on insulation layer 3*d* provided with vias 12*a*, 12*b*, 12*c*, 12*d*, 12*e*, 12*f* and 12*g*.

Then, as illustrated in FIG. 9(A), conductive film 13 is processed through photolithographic etching to form coil patterns 13*a*, 13*b*, 13*c* and 13*d*.

As a result, one end of coil pattern 13*a* is led out through via 12*a* and connected to the other end of lead-out electrode 11*a*, and the other end of coil pattern 13*a* is connected through via 12*b* to one end of coil pattern 11*b*. One end of coil pattern 13*b* is connected through via 12*c* to the other end of coil pattern 11*b*, and the other end of coil pattern 13*b* is connected through via 12*d* to one end of coil pattern 11*c*. One end of coil pattern 13*c* is connected through via 12*e* to the other end of coil pattern 11*c*, and the other end of coil pattern 13*c* is connected through via 12*f* to one end of coil pattern 11*d*. One end of coil pattern 13*d* is connected through via 12*g* to the other end of coil pattern 11*d*. The other end of coil pattern 13*d* is led out to the outer edge of insulation layer 3*d* to form a lead-out section of a rectangular shape in the vicinity of the outer edge for connecting with terminal electrode 7.

Similarly to the first coil, in order to improve the connection reliability in the second coil, the other end of coil pattern 13*a*, both ends of coil pattern 13*b*, both ends of coil pattern 13*c* and one end of coil pattern 13*d* are formed into a portion having a wider width widened with equal size from the center of the coil pattern to both sides thereof in the width direction in comparison to another portion adjoining to each end. Meanwhile, a portion of the coil pattern which is adjacent to the portion having the wider width across a gap extending along the coil pattern in a direction parallel to the coil pattern is formed to have a narrower width narrowed with equal size from the center of the coil pattern to both sides thereof in the width direction in comparison to another portion joining the portion. The size widened for the portion having the wider width (the size difference between the width of the widened portion and the width of the adjoining portion) and the size narrowed for the portion having the narrower width (the size difference between the width of the narrowed portion and the width of the adjoining portion) are equal to each other. As a result, the width of the gap formed between the portion having the wider width and the portion having the narrower width is equal to the width of the gap formed between the portions without being formed into the portion having the wider width or the portion having the narrower width.

The second coil formed as mentioned above has a coil path including sequentially terminal electrode 6, lead-out electrode 11*a*, via 12*a*, coil pattern 13*a*, via 12*b*, coil pattern 11*b*, via 12*c*, coil pattern 13*b*, via 12*d*, coil pattern 11*c*, via 12*e*, coil pattern 13*c*, via 12*f*, coil pattern 11*d*, via 12*g*, coil pattern 13*d*, and terminal electrode 7. The second coil is also configured to have the coil patterns passing through one surface and the other surface of insulation layer 3*d* alternately for multiple times and have a long coil length.

Next, as illustrated in FIG. 9(B), an insulation layer 3*e* is formed on insulation layer 3*d* provided with coil patterns 13*a*, 13*b*, 13*c* and 13*d*.

Then, as illustrated in FIG. 10, second magnetic substrate 2 is bonded onto insulation layer 3*e* through an adhesive agent (not shown).

Consequently, as illustrated in FIG. 1, a final laminator is achieved with first magnetic substrate 1 and second magnetic substrate 2 sandwiching therebetween laminate body 3.

As mentioned above, laminate body 3 is an integrated laminator of insulation layers 3*a* to 3*e*, and encloses therein the first coil composed of coil patterns 8*a* to 8*d*, vias 9*a* to 9*g*, coil patterns 10*a* to 10*c* and lead-out electrode 10*d*, and the second coil composed of lead-out electrode 11*a*, coil patterns 11*b* to 11*d*, vias 12*a* to 12*g*, and coil patterns 13*a* to 13*d*. The first coil and the second coil are electromagnetically coupled.

Since each of coil patterns 8*a* to 8*d* and 13*a* to 13*d* is formed in line symmetry with respect to the center line of the coil pattern as illustrated in FIG. 11 (FIG. 11 is a plan view illustrating a main part where coil patterns 8*a* to 8*d* are provided), the width of gap G1 defined between the widened portion having a wider line width (w) and the narrowed portion having a narrower line width (n) is identical to the width of gap G2 defined between the portions without being formed into the widened portion or the narrowed portion and having a line width (s), and thereby, common-mode choke coil 100 is extremely suitable to be made through photolithography (photolithographic etching). In other words, if the coil pattern is not formed in line symmetry with respect to the center line of the coil pattern but formed biasing to either side or with different gap width, the formation of the coil pattern through photolithography is unstable, and thus, the coil pattern may encounter problems such as disconnections or short-circuits to adjacent coil patterns. However, the common-mode choke coil according to the present embodiment is free of such problems and is high in connection reliability.

It is acceptable that the gap formed between one coil pattern of coil patterns 8*a* to 8*d* and 13*a* to 13*d* and an adjacent coil pattern to the one coil pattern has the same width across the whole region where said two coil patterns are adjacent to each other. Thereby, the formation of coil patterns through photolithography is more stable, resulting in higher connection reliability.

Finally, as illustrated in FIG. 1, terminal electrodes 4, 5, 6 and 7 are provided on the surface of the laminator composed of first magnetic substrate 1, laminate body 3 and second magnetic substrate 2 by for example baking a conductive paste to offer common-mode choke coil 100 according to the present embodiment.

Examples of the structure of common-mode choke coil 100 and the production method thereof according to the embodiment of the coil component of the present disclosure have been described above. However, the present disclosure is not limited to those describe above, and various modifications can be made without departing from the spirit of the disclosure.

For example, in the above embodiment, a common-mode choke coil is shown as the coil component, but the coil component of the present disclosure is not limited thereto and may be a power inductor, a high-frequency matching inductor, an isolation transformer, a balun, or a coupler.

It is described above that a single common-mode choke coil is produced in the production method. However, it is acceptable that a large number of common-mode choke coils are produced in a batch on a mother substrate and then the mother substrate is divided into individual common-mode choke coils and the terminal electrodes are provided on each choke coil thereafter.

The invention claimed is:

1. A coil component comprising a laminate body formed by stacking an insulation layer and a plurality of coil patterns in a thickness direction, said plurality of coil patterns provided on one surface of said insulation layer and a plurality of coil patterns provided on the other surface of said insulation layer being connected at multiple locations through a plurality of vias formed to penetrate said insulation layer and pass through said one surface and the other surface of said insulation layer alternately so as to form a coil, at least said plurality of coil patterns provided on said one surface of said insulation layer or said plurality of coil patterns provided on the other surface of said insulation layer being configured in such a manner that a first portion in contact with said via has a wider width widened with equal size from a center of a coil pattern to both sides thereof in a width direction in comparison to another portion which is not in contact with said via joining said first portion, a second portion adjacent to said first portion having said wider width across a gap extending along said coil pattern in a direction parallel to said coil pattern has a narrower width narrowed with equal size from the center of said coil pattern to both sides thereof in the width direction in comparison to another portion joining said second portion, a size difference change for said first portion having said wider width and a size difference change for said portion having said narrower width being equal to each other, and said plurality of vias formed to penetrate said insulation layer being configured to have a longer length in a longitudinal direction of said coil pattern as said plurality of vias move closer to an outer periphery of said insulation layer from a center of said insulation layer.

2. The coil component according to claim 1, wherein said plurality of vias formed to penetrate said insulation layer are arranged in a zigzag manner from the center of said insulation layer toward any side of said insulation layer.

3. The coil component according to claim 1, wherein the gap formed between any two adjacent coil patterns among at least said plurality of coil patterns provided on said one surface of said insulation layer or said plurality of coil patterns provided on the other surface of said insulation layer has a same width across an entire region where said two coil patterns are adjacent to each other.

4. The coil component according to claim 1, wherein the coil component includes a first magnetic substrate, said laminate body is provided on said first magnetic substrate, and a second magnetic substrate is provided on said laminate body.

5. The coil component according to claim 1, wherein said laminate body is formed through photolithography.

6. The coil component according to claim 1, wherein said laminate body is provided with two coils, and said coil component is a common-mode choke coil.

* * * * *